United States Patent [19]

Sackenreuter et al.

[11] 3,986,431

[45] Oct. 19, 1976

[54] TUBULAR FIREARM WITH STRIKER AND SEALING LIP

[75] Inventors: Hans Sackenreuter, Ruckersdorf; Anton Politzer, Lauf; Edmund Schrauf, Reichenschwand; Helmut Könicke, Rothenbach, all of Germany

[73] Assignee: DIEHL, Nuremberg, Germany

[22] Filed: Feb. 6, 1975

[21] Appl. No.: 547,970

[30] Foreign Application Priority Data

Feb. 7, 1974 Germany ..... 2405762

[52] U.S. Cl. ..... 89/26

[51] Int. Cl.[2] ..... F41F 11/04

[58] Field of Search ..... 89/26, 1 E, 1 R, 132

[56] References Cited

UNITED STATES PATENTS

| | | | |
|---|---|---|---|
| 1,015,226 | 1/1912 | Cudia | 89/1 E UX |
| 1,401,241 | 12/1921 | Dawson et al. | 89/1 E |
| 2,480,100 | 8/1949 | Weiss et al. | 89/26 X |
| 3,008,258 | 11/1961 | Johnson | 89/26 X |
| 3,547,001 | 12/1970 | Stoner | 89/26 X |
| 3,680,241 | 8/1972 | Ramsay | 89/26 UX |
| 3,783,737 | 1/1974 | Ashley | 89/26 X |

*Primary Examiner*—David H. Brown
*Attorney, Agent, or Firm*—Walter Becker

[57] ABSTRACT

A tubular firearm in which a striker is guided in the bore of a bottom section of the cartridge chamber housing while the bottom section has a longitudinal bore therein with a chamber for receiving and storing a viscous fluid. A striker is reciprocable in the longitudinal bore and is provided with recess means while means, for instance a cam, is operatively connected to the striker for moving the same from a starting position to a striking position. The arrangement is such that when the striker occupies its starting position, the recess means are located within the region of the chamber adapted to receive and store viscous fluid. According to an embodiment of the invention, the striker is connected with an impact member through a joint having three degrees of freedom.

8 Claims, 4 Drawing Figures

FIG.1
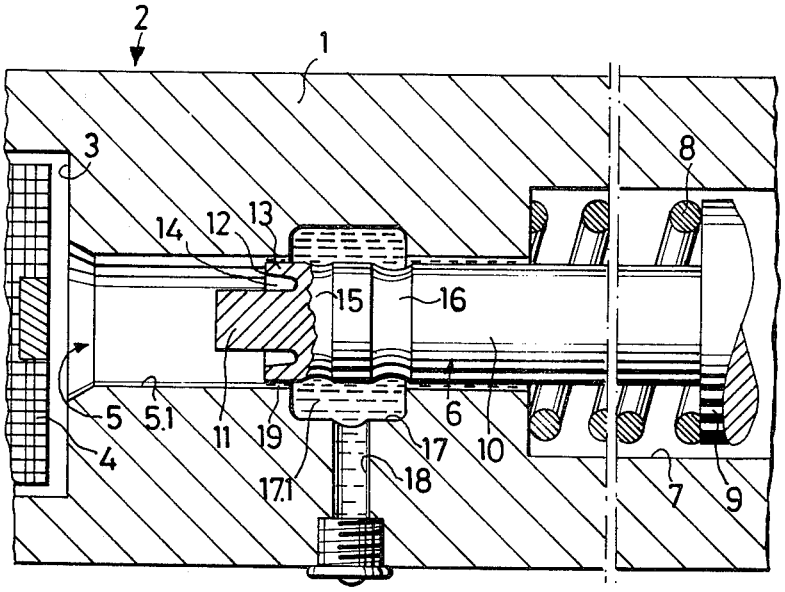
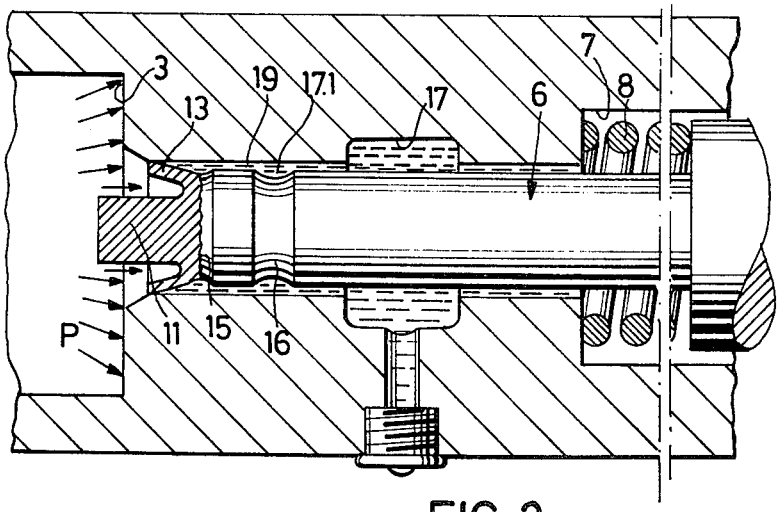
FIG. 2

TUBULAR FIREARM WITH STRIKER AND SEALING LIP

For igniting sleeveless propelling charges in tubular fire arms, there exists the problem of a permanent seal between the striker and the bottom member of the cartridge chamber against the high tensioned hot gases of the propelling charge, in particular, when the striker also carries out a movement during the time the gas pressure is effective. When the gas of the propelling charge contains abrasive residues, especially of the detonator composition it will be appreciated that at the guiding surfaces of the striker or the bore wall of the bottom member considerable wear occurs.

It is, therefore, an object of the present invention to provide a striker with a sealed guide for the striker.

This object and other objects and advantages of the invention will appear more clearly from the following specification, in connection with the accompanying drawings, in which:

FIG. 1 illustrates a striker in its starting position.

FIG. 2 shows the striker at its reversing point.

Figure 3:
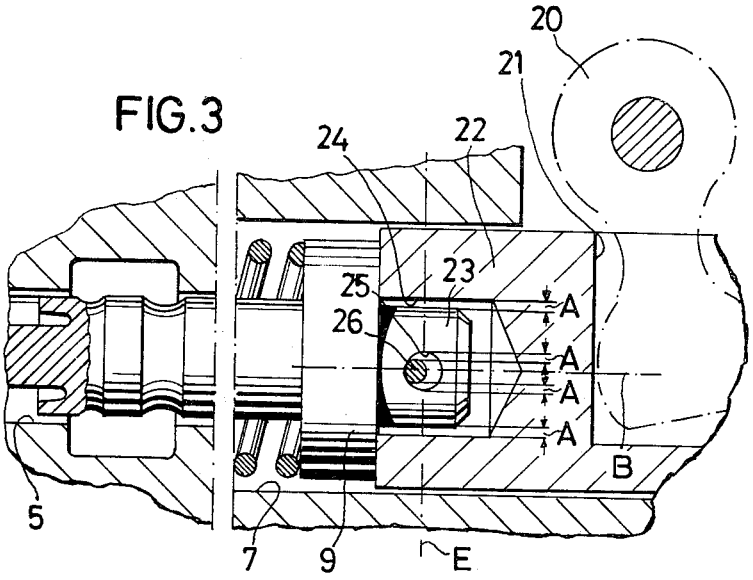
FIG. 3 shows a striker with axial tolerance compensation.

The striker according to the present invention is characterized primarily in that the bore comprises at least a lubricating intermediate chamber for receiving a viscous liquid, and that the striker is provided with pocket-shaped recesses which when the striker is in its starting position are located within the region of the intermediate lubricating chamber.

Due to taking advantage of the properties of viscous liquids in a narrow gap, a proper seal and a highly wear-resistant and easy moveability of the striker will be assured over a great number of firings. This is aided by the fact that the striker itself conveys the lubricant to the guiding surfaces.

According to a further development of the invention, the front end of the striker is provided with an annular sealing lip which increases the staying time of the seal. This sealing lip will when being exposed to the gas pressure, due to an elastic widening, bring about an intimate contact at the wall of the bore of the bottom member while a lubricating film will be retained. The thus prevailing increase in the diameter of the sealing lip due to the gas pressure and the heat expansion will due to this lubricating film prevent a jamming of the striker. By means of the sealing lip, already during the build up of the gas pressure, a sealing effect will be realized.

According to a further development of the invention, with the sealed guide for the striker, the problem will be solved to prevent a clamping or jamming of the striker in its starting position. This may occur when guiding bores are located relative to each other in an eccentric or angularly different position, or when the hammer beats on a detonating member eccentrically with regard to the axis of the bore.

Referring now to the drawings in detail, and FIG. 1 thereof in particular, in the bottom member 1 of a cartridge chamber housing 2 there is provided a cartridge chamber 3 for a sleeveless propelling charge 4, a bearing bore 5 for a striker 6, and a bore 7 for a spring 8. The illustrated starting position of the striker 6 is brought about by a cam 20 (see FIG. 3).

The striker 6 is divided into a shank 9, bolt 10 and a firing pin 11. A spring 8 is clamped in between the shank 9 and the bottom member 1. The bolt 10 which has a smaller diameter that that of shank 9 has at its end face 12 a sealing lip 13 which is formed by a recess 14 at the end face. Adjacent said sealing lip 13 there is provided a annular-shaped recess 15 which is located on the circumference of the bolt and which is followed by a further recess 16. The bottom member 1 extends by means of a lubricating chamber 17 around the two recesses 15 and 16. A lubricant bore 18 leads into said chamber 17 which is adapted to be filled with a silicon grease 17.1.

For purposes of igniting the propelling charge 4, the striker 6 is, by means of cam 20, moved toward the cartridge chamber 3 (FIG. 2). In this connection, the annular-shaped recesses 15, 16 feed the silicon grease 17.1 into the section 5.1 of the bearing bore 5, which section is located between the lubricant chamber 17 and the cartridge chamber 3. This grease is, by repeated movement of the striker distributed over the entire section 5.1. In this way, it will be realized that the radial space 19 between the bolt 10 or sealing lip 13 on one hand and the bearing bore 5 on the other hand is filled with grease so that a so-called floating mounting is provided for the striker 6. While during a continuous firing a small quantity of the grease is used up, a refilling of the grease supply is, however, necessary only at greater intervals. The sealing lip 13 is, by the gas pressure, circumferentially elastically widened and therefore has an intimate contact with the section 5.1 of the bearing bore 5. The intermediate space 19 is at the sealing lip within a certain maximum pressure range reduced to nearly zero while, however, the grease layer remains maintained between the sealing lip and the section 5.1.

Figure 4:
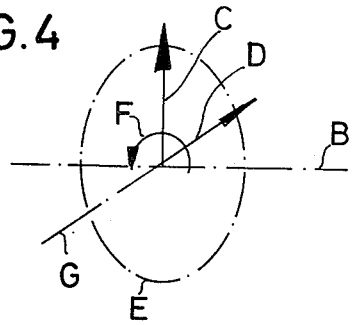
FIG. 4 is a diagram with degrees of freedom.

According to FIG. 3, a hammer in the form of an engagement means or a cam 20 engages a recess 21 of an impact member 22 occupying its starting position. The impact member 22 is displaceably mounted in bore 7 and at its end face engages the shank 9. A striker foot 23 is journaled in a bore 24 with a radial intermediate space two times that of A. This intermediate space is also present with a bore 25 on the side of the striker and with a transverse pin 26 on the side of said impact member 22. This hinge arrangement of the striker foot 23 and impact member 22 may compensate for the guiding tolerances caused by the manufacturing process or by wear and in this way contributes to a long life of the striker 6, inasmuch as a clamping of the sealing lip 13 in bore 5 is avoided. The hinge arrangement according to FIG. 4 has the following three degrees of freedom.

Starting from the axis of the bore B there are two degrees of freedom C, D which are located in the cross-sectional plane E extending through the bores 7, 25. There is a further degree of freedom F as rotary movement about the transverse pin axis G.

The following guiding tolerances are compensated for:

Parallel offset of the bores 5, 7, angular offset of bores 5, 7, and the point of attack of the cam 20 on the impact member 22, which point of attack is located eccentrically with regard to the axis of the bore.

For purposes of igniting the propelling charge 4, the cam 20 is moved in clockwise direction. This cam 20 displaces the impact member 22 and the striker 6 adjacent thereto into its end position (FIG. 3). The gas pressure of the ignited propelling charge 4 and the cams 20 then bring about the illustrated starting position (FIGS. 1 and 3).

It is, of course, to be understood that the present invention is, by no means, limited to the specific showing in the drawings, but also comprises any modifications within the scope of the appended claims.

What we claim is:

1. In combination in a tubular weapon: a cartridge chamber housing comprising a bottom section with a bore having chamber means therein for receiving and storing a viscous fluid, a striker reciprocable in said bore and provided with recess means, and engagement means operatively connected to said striker for moving the same from a starting position to a striking position, the arrangement being such that when said striker occupies its starting position said recess means are located within the region of said chamber means.

2. An arrangement according to claim 1, which includes conduit means provided in said bottom section and leading from the outside of said cartridge chamber housing into said chamber means for conveying lubricant thereto.

3. An arrangement according to claim 1, which includes spring means associated with said striker and continuously urging the same into non-striking position.

4. An arrangement according to claim 1, in which said engagement means includes an impact member arranged therewith adjacent the rear end of said striker, said striker being operatively connected to said impact member through joint means having three degrees of freedom.

5. An arrangement according to claim 4, in which said striker has its rear portion provided with a transverse bore and a transverse pin extending through said transverse bore, said transverse bore having a diameter considerably greater than the diameter of said transverse pin.

6. An arrangement according to claim 1, in which said striker has a front end provided with an annular sealing lip.

7. An arrangement according to claim 6, in which said recess means is closely adjacent said sealing lip.

8. An arrangement according to claim 6, in which said sealing lip has an end portion thereof provided with annular groove means, and in which said striker has its front end provided with a firing pin projecting beyond said sealing lip, the outer diameter of said firing pin corresponding approximately to the inner diameter of said annular groove means.

* * * * *

UNITED STATES PATENT OFFICE

CERTIFICATE OF CORRECTION

Patent No. 3,986,431 Dated Oct. 19, 1975

Inventor(s) Hans Sackenreuter et al.

It is certified that error appears in the above-identified patent and that said Letters Patent are hereby corrected as shown below:

Item [73] Assignee: should read:
-- DIEHL, Nürnberg, Germany --.

Signed and Sealed this

Fifteenth Day of February 1977

[SEAL]

*Attest:*

RUTH C. MASON
*Attesting Officer*

C. MARSHALL DANN
*Commissioner of Patents and Trademarks*